US005286907A

United States Patent [19]

Okamura et al.

[11] Patent Number: 5,286,907

[45] Date of Patent: Feb. 15, 1994

[54] APPARATUS FOR REPRODUCING MUSICAL ACCOMPANIMENT INFORMATION

[75] Inventors: Mashiro Okamura; Masuhiro Sato; Naoto Inaba; Yoshiyuki Akiba; Toshiki Nakai, all of Tokyo, Japan

[73] Assignee: Pioneer Electronic Corporation, Tokyo, Japan

[21] Appl. No.: 775,147

[22] Filed: Oct. 9, 1991

[30] Foreign Application Priority Data

Oct. 12, 1990 [JP] Japan ..... 2-273733
Nov. 26, 1990 [JP] Japan ..... 2-321489

[51] Int. Cl.[5] ..... G10H 1/36

[52] U.S. Cl. ..... 84/601; 84/610; 84/625; 84/645; 84/660; 84/665; 84/650

[58] Field of Search ..... 84/600, 607, 610, 621, 84/622, 625, 645, 659, 661, 665, 725, DIG. 9, 462, 470, 650

[56] References Cited

U.S. PATENT DOCUMENTS

| | | | |
|---|---|---|---|
| Re. 33,607 | 6/1991 | Yuzawa et al. | 84/609 |
| 3,955,466 | 5/1976 | Goldmark | 84/470 |
| 4,584,921 | 4/1986 | Wachi | 84/605 |
| 4,637,049 | 1/1987 | Kunugi | 381/86 |
| 4,702,142 | 10/1987 | Deutsch | 84/605 |
| 4,771,671 | 9/1988 | Hoff, Jr. | 84/453 X |
| 4,785,702 | 11/1988 | Katoh | 84/604 |
| 4,903,565 | 2/1990 | Abe | 84/611 |
| 4,930,390 | 6/1990 | Kellogg et al. | 84/611 |
| 4,936,183 | 6/1990 | Rauchi et al. | 84/610 |
| 4,995,026 | 2/1991 | Makobe et al. | 369/70 |
| 5,033,036 | 7/1991 | Ohmori et al. | 369/3 |
| 5,038,660 | 8/1991 | Watanabe | 84/601 |
| 5,046,004 | 9/1991 | Tsumura et al. | 84/601 X |
| 5,054,360 | 10/1991 | Lisle et al. | 84/645 |
| 5,062,097 | 10/1991 | Kumaoka | 84/645 X |
| 5,079,984 | 1/1992 | Kosugi et al. | 84/645 |
| 5,127,303 | 7/1992 | Tsumura et al. | 84/609 |
| 5,131,311 | 7/1992 | Murakami et al. | 84/609 |
| 5,142,961 | 9/1992 | Paroutard | 84/726 |

OTHER PUBLICATIONS

Fairlight Instruments, Voicetracker, product view, 1985.

*Primary Examiner*—William M. Shoop, Jr.
*Assistant Examiner*—Brian Sircus
*Attorney, Agent, or Firm*—Kane, Dalsimer, Sullivan, Kurucz, Levy, Eisele and Richard

[57] ABSTRACT

There are disclosed an apparatus adapted to generate musical information of a synthetic sound in accordance with the MIDI (Musical Instrument Digital Interface) standard to carry out PCM (Pulse Code Modulation) recording of a natural effect sound including natural sound and/or a human voice such as back chorus to mix them to generate musical accompaniment, thus to mix a voice of singing sung with the musical accompaniment, and a recording medium used for such an apparatus.

7 Claims, 13 Drawing Sheets

FIG. 3(A)
| BYTE | DATA | |
|---|---|---|
| 1 | Status Byte | LF21 |
| 2 ~ 5 | Track Length | LF22 |
| 6 | Status Byte | LF23 |
| 7 ~ 8 | Lyrics Display Color | LF24 |
| 9 | Status Byte | LF25 |
| 10 ~ 11 | Lyrics Scroll Color | LF26 |
| 11 ~ n | Lyrics Data | LF3 |
| n ~ m | Timing Map | LF4 |
| m+1 ~ m+2 | Track End Data | LF5 |
LF2
FIG. 3(B)
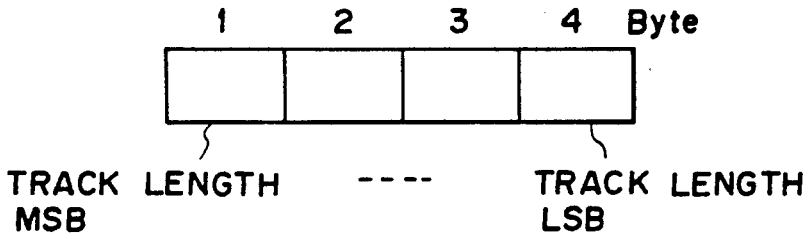
FIG. 3(C)
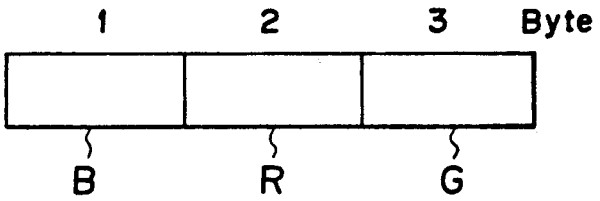

| B | R | G | COLOR |
|---|---|---|---|
| O | O | O | BLACK |
| O | A | A | MUD YELLOW |
| O | A | F | OLIVE COLOR |
| A | O | F | YOUNG GRASS COLOR |
| A | A | A | GRAY |
| A | A | F | BROWNISH GREEN |
| A | F | A | ROSE |
| F | O | F | BLUE |
| F | A | O | VIOLET |
| F | F | O | PURPLE |
| F | F | F | WHITE |

FIG. 6

| MUSICAL COMPOSITION NO. | TITLE OF MUSICAL COMPOSITION | LYRICS WRITER MUSICAL COMPOSER | NAME OF SINGER | LYRICS FOR RETRIEVAL |
|---|---|---|---|---|
| 01 | OOOO | OOOO OOOO | OOOO | OOO. OO ---- |
| 02 | ⋮ | ⋮ | ⋮ | ⋮ |
| ⋮ | ⋮ | ⋮ | ⋮ | ⋮ |
| ⋮ | ⋮ | ⋮ | ⋮ | ⋮ |
| n | ⋮ | ⋮ | ⋮ | ⋮ |

FIG. 7

| RESERVATION NO. | NAME OF PERSON WHO MAKES RESERVATION | TITLE OF MUSICAL COMPOSITION |
|---|---|---|
| 01 | OOOO | OOO |
| 02 | OOOO | OOO |
| ⋮ | ⋮ | ⋮ |
| ⋮ | ⋮ | ⋮ |
| n | ⋮ | ⋮ |

APPARATUS FOR REPRODUCING MUSICAL ACCOMPANIMENT INFORMATION

BACKGROUND OF THE INVENTION

The present invention relates to an apparatus for reproducing musical accompaniment information and for recording musical accompaniment information, and more particularly to a musical accompaniment playing apparatus and a musical accompaniment recording medium to which a MIDI(Musical Instrument Digital Interface) is applied.

Hitherto, as the musical accompaniment playing apparatus, there are known the playing apparatus in the form of a laser video disk and the playing apparatus in the form of a compact disk.

The apparatus for reproducing musical accompaniment information in the form of a laser video disk (LVD) comprises a LVD automatic changer for accommodating therein a plurality of laser video disks serving as the musical accompaniment information recording medium and reproducing them, a commander for controlling the LVD automatic changer to allow it to select a desired laser video disk in the LVD automatic changer by a request inputted from a control unit, an amplifier and a speaker for outputting a reproduced audio signal as a sound, an image display unit for displaying a reproduced image signal as an image, and a microphone for changing a voice sung to an audio sound to output it to the amplifier. The amplifier mixes the audio signal from the LVD automatic changer and the audio signal of the voice sung from the microphone to output a mixed signal to the speaker.

On the other hand, the apparatus for reproducing musical accompaniment information in the form of a compact disk (CD) comprises a CD automatic changer for accommodating therein a plurality of CDs and reproducing them, a commander for controlling the CD automatic changer to allow it to select a desired CD in the CD automatic changer by a request inputted from a control unit, an amplifier and a speaker for outputting a reproduced audio signal as a sound, a graphic decoder for converting graphic data reproduced from subcode data in the CD to an image signal, a graphic display unit for displaying the image signal as an image, and a microphone for changing a voice sung to an audio signal to output it to the amplifier. The amplifier mixes the audio signal from the CD automatic changer and the audio signal of the voice sung from the microphone to output a mixed signal to the speaker.

By employing such configurations, a user can sing a song by the musical accompaniment and also appreciate an image at the same time.

However, in the media for recording musical accompaniment information and the apparatuses for reproducing musical accompaniment information in these conventional forms, in the case where a new music is delivered to the apparatus, it is required to deliver the laser video disks or CDs by human labor. Accordingly, there was the problem that it takes much time for delivery of a new music at a remote place, etc.

Further in the automatic changer, a large space was required for the purpose of accommodating a large number of disks.

Furthermore, in the case of singing a song, when an attempt is made to allow the key of the musical accompaniment to be in correspondence with a singing ability of a singer, a key controller was separately installed.

In addition, in the conventional recording media and apparatuses, once a musical performance begins, it was impossible to play a music with an intermediate portion of a music being skipped. For example, suppose the case where a music is composed of three parts. At this time, in the case of attempting to jump from the second part immediately to the ending with the third part being skipped, even if the function for performing the search operation is given, time lag is produced by a time required for the search operation, there results disagreement with the stream of music. Further, if the search operation is caused to be stopped on the way, the ending would not be played, resulting in dull musical accompaniment performance. Thus, development of a music as expected cannot be provided.

On the other hand, recording media such as disks or tapes, etc. on which a music for accompaniment is recorded are apt to be copied. As a result, there were instances where a trouble at the time of the collection of the charge by deliverer of delivery of software and/or that in relation to the copyright thereof occur.

SUMMARY OF THE INVENTION

An object of the present invention is to provide an apparatus for reproducing musical accompaniment information, which is easy to deliver a new music, is small in a space for installation, and further has a key control function, and a medium for recording musical accompaniment information including information recording format used in such an apparatus.

Another object of the present invention is to provide an apparatus for reproducing musical accompaniment information, which is capable of playing a music with the middle portion of the music being skipped and has copy protection as well, and a medium for recording musical accompaniment information including information recording format used in such an apparatus.

According to one preferred aspect of the present invention, there is provided a musical accompaniment information recording medium, which is adapted to be reproduced by an apparatus for reproducing musical accompaniment information comprising:

an information reproducing unit for reproducing MIDI sound source control information from the musical accompaniment information recording medium on which the MIDI sound source control information for controlling a MIDI sound source unit to generate musical information in conformity with a MIDI standard is recorded;

the MIDI sound source unit for generating the musical information by the MIDI sound source control information reproduced by the information reproducing unit, an acoustoelectric transducer for transforming a voice sung by a singer to an electric signal to output it as voice information.

a mixing unit for mixing the musical information and the voice information to output it as mixed musical information; and a sound output unit for transforming the mixed musical information to sound to output it;

the musical accompaniment information recording medium comprising:

a first information recording region on which the MIDI sound source control information for controlling the MIDI sound source unit to generate first musical information in conformity with the MIDI standard is recorded; and a second information recording region on which second musical information mixed with the first musical information to form the musical accompaniment information is recorded.

In the above mentioned musical accompaniment information recording medium, the second musical information may be sound having sound effect including pulse code modulated natural sound or human voice including background chorus.

Further, the medium may include a third information recording region where related information related &o the contents of the musical accompaniment information is recorded.

Furthermore, the third information recording region may include a fourth information recording region where lyrics information to be sung in harmony with the musical accompaniment information is recorded.

In this fourth information recording region, a plurality of lyrics information to be sung in harmony with musical accompaniment information may be stored.

Further, the third information recording region may include a fifth information recording region there retrieval information permitting retrieval of the musical accompaniment information is recorded.

The MIDI sound source control information or the second musical information may be erasable or writable.

Further, the MIDI sound source control information, the second musical information or the related information may be erasble or writable.

Furthermore, the MIDI sound source control information, the second musical information or the lyrics information may be erasable or writable.

In addition, the MIDI sound source control information, the second musical information or the retrieval information may be erasable or writable.

In accordance with the above mentioned configuration, since the musical accompaniment information is mixed information of digital information generated in conformity with the MIDI standard and Pulse Code Modulated information, more quantity of information can be recorded in the same information recording region.

According to another preferred aspect of the present invention, there is provided an apparatus for reproducing musical accompaniment information comprising:

an information reproducing unit for reproducing MIDI sound source control information from a musical accompaniment information recording medium on which the MIDI sound source control information for controlling a MIDI sound source unit to generate the musical accompaniment information in conformity with a MIDI standard is recorded;

the MIDI sound source unit for generating the musical accompaniment information by the MIDI sound source control information reproduced by the information reproducing unit;

an acoustoelectric transducer for transforming a voice sung by a singer to an electric signal to output it as voice information;

a mixing unit for mixing the musical accompaniment information and the voice information to output it as mixed musical information: and a sound output unit for transforming the mixed musical information to sound to output it.

In the above mentioned apparatus, the MIDI sound source control information may be erasable or writable.

The above mentioned apparatus may include:

information reproduction means for reproducing the MIDI sound source control information and the second musical information from above described musical accompaniment information recording medium:

a MIDI sound source unit for generating the first musical information by the MIDI sound source control information reproduced by the information reproducing unit;

an acoustoelectric transducer for transforming a voice sung by a singer to an electric signal to output it as voice information;

a mixing unit for mixing the generated first musical information, the reproduced second musical information and the voice information to output it as mixed musical information; and a sound output unit for transforming the mixed musical information to sound to output it.

Further, the above mentioned apparatus may include:

an information reproducing unit for reproducing the MIDI sound source control information, the second musical information and the related information;

a MIDI sound source unit for generating the first musical information by the MIDI sound source control information reproduced by the information reproducing unit;

an acoustoelectric transducer for transforming a voice sung by a singer to an electric signal to output it as voice information;

a mixing unit for mixing the generated first musical information, the reproduced second musical information and the voice information to output it as mixed musical information;

a sound output unit for transforming the mixed musical information to sound to output it; and an image display unit for displaying an image corresponding to the reproduced related information.

Further, the above mentioned apparatus may include:

an information reproducing unit for reproducing the MIDI sound source control information, the second musical information and the lyrics information;

a MIDI sound source unit for generating the first musical information by the MIDI sound source control information reproduced by the information reproducing unit;

an acoustoelectric transducer for transforming a voice sung by a singer to an electric signal to output it as voice information;

a mixing unit for mixing the generated first musical information, the reproduced second musical information and the voice information to output it as mixed musical information;

a sound output unit for transforming the mixed musical information to sound to output it;

an image display unit for displaying an image corresponding to the reproduced lyrics information; and a control unit for controlling output timings of sound outputted from the sound output unit and an image displayed by the image display unit Further, the above mentioned apparatus may include:

an information reproducing unit for reproducing the MIDI sound source control information, the second musical information and the retrieval information;

a MIDI sound source unit for generating the first musical information by the MIDI sound source control information reproduced by the information reproducing unit;

an acoustoelectric transducer for transforming a voice sung by a singer to an electric signal to output it as voice information;

a mixing unit for mixing the generated first musical information, the reproduced second musical information and the voice information to output it as mixed musical information, a sound output unit for transforming the mixed musical information to sound to output it; and an image display unit for displaying an image corresponding to the reproduced retrieval information.

In accordance with the above mentioned configuration, since the musical accompaniment and a song sung by a singer in harmony with the musical accompaniment are mixed, and outputted as sound, the singer can enjoy singing.

Further, the above mentioned the musical accompaniment information recording medium may include a first information recording region for recording MIDI sound source control information including first jump start address information and first jump end address information for controlling the MIDI sound source unit to generate musical accompaniment information in conformity with the MIDI standard, and for jumping an information generation operating position from an arbitrary position in the musical accompaniment information to an arbitrary position in the musical accompaniment information Alternatively, in the above mentioned musical accompaniment information recording medium, first jump start address information and first jump end address information for jumping an information generation operating position from an arbitrary position in the musical accompaniment information to an arbitrary position in the musical accompaniment information may be recorded in the first information recording region, and second jump start address information and second jump end address information for jumping an information generation operating position from an arbitrary position in the second musical information to an arbitrary position in the second musical information may be recorded in a second information recording region.

Further, in the above mentioned recording medium, third jump start address information and third jump end address information for jumping an information generation operating position from an arbitrary position in the lyrics information to an arbitrary position in the lyrics information may be recorded in the fourth information recording region.

According to still another preferred aspect of the present invention, there is provided an apparatus for reproducing musical accompaniment information comprising:

an information reproducing unit for reproducing the MIDI sound source control information from the above mentioned musical accompaniment information recording medium;

the MIDI sound source unit for generating the first musical information by the MIDI sound source control information reproduced by the information reproducing unit;

an acoustoelectric transducer for transforming a voice sung by a singer to an electric signal to output it as voice information;

a mixing unit for mixing the first musical information generated by the MIDI sound source unit and the voice information to output it as mixed musical information;

a sound output unit for transforming the mixed musical information to sound to output it; and a control unit for controlling the information reproducing unit, when the first jump start address information is detected, so as to jump the information reproduction operating position from an information position of the first jump start address information to an information position of the first jump end address information thereafter to restart reproduction of the MIDI sound source control information from the information position of the first jump end address information.

Further, the above mentioned apparatus may include:

an information reproducing unit for reproducing the MIDI sound source control information and the second musical information from the above mentioned musical accompaniment information recording medium:

a MIDI sound source unit for generating the first musical information by the MIDI sound source control information reproduced by the information reproducing unit;

an acoustoelectric transducer for transforming a voice sung by a singer to an electric signal to output is as voice information;

a mixing unit for mixing the first musical information generated by the MIDI sound source unit, the reproduced second musical information and the voice information to output it as mixed musical information;

a sound output unit for transforming the mixed musical information to sound to output it; and a control unit for controlling the information reproducing unit, when the first jump start address information is detected so as to jump an information reproduction operating position from an information position of the first jump start address information to an information position of the first jump end address information thereafter to restart reproduction of the MIDI sound source control information from the information position of the first jump end address information, and to jump an information reproduction operating position from an information position of the second jump start address information to an information position of the second jump end address information thereafter to restart reproduction of the second musical information from the information position of the second jump end address information.

Alternatively, the above mentioned apparatus may include:

an information reproducing unit for reproducing the MIDI sound source control information, the second musical information and the lyrics information from the above mentioned musical accompaniment information recording medium;

a MIDI sound source unit for generating first musical information by the MIDI sound source control information reproduced by the information reproducing unit;

an acoustoelectric transducer for transforming a voice sung by a singer to an electric signal to output it as voice information;

a mixing unit for mixing the generated first musical information, the reproduced second musical information and the voice information to output it as mixed musical information;

a sound output unit for transforming the mixed musical information to sound to output it;

an image display unit for displaying an image corresponding to the reproduced lyrics information; and a control unit for controlling output timings of sound outputted from the sound output unit and output timings of image displayed by the image display unit, and controlling the information reproducing unit, when first jump start address information is detected, so as to jump an information reproduction operating position from an information position of the first jump start address information to an information position of the first jump end address information thereafter restart reproduction of the MIDI sound source control information from the information position of the first jump end address information, to jump an information reproduction operating position from an information position of the second jump start address information to an information position of the second jump end address information thereafter to restart reproduction of the second musical information from the information position of the second jump end address information, and to jump an information reproduction operating position from an information position of third jump address start address information to an information position of the third jump end address information thereafter to restart reproduction of the lyrics information from the information position of the third jump end address information.

By employing such a configuration, it is possible to reproduce, without time lag, music in a manner that the middle portion of the music is omitted.

According to a still another preferred aspect of the present invention, there is provided an apparatus for reproducing musical accompaniment information comprising:

a first information recording/reproduction unit having a function to reproduce or erase MIDI sound source control information from a first musical accompaniment information recording medium in which recording, erasing or rewriting of the MIDI sound source control information for controlling MIDI sound source unit to generate musical accompaniment information in conformity with a MIDI standard can be conducted, or to write other information onto the first musical accompaniment information recording medium;

a second information recording/reproducing unit having a function to record the MIDI sound source control information reproduced by the first information recording/reproducing unit onto a second musical accompaniment information recording medium in which recording, erasing or rewriting of the MIDI sound source control information can be conducted;

a control unit for controlling to record information contents recorded on the first musical accompaniment information recording medium onto the second musical accompaniment information recording medium, when the first musical accompaniment information recording medium is loaded into the first information recording-/reproducing unit, and to change the information contents recorded on the first musical accompaniment information recording medium for the purpose Of protection of copying;

a MIDI sound source unit for generating the musical accompaniment information by the MIDI sound source control information from the second musical accompaniment information recording medium reproduced by the second information recording/reproducing unit;

an acoustoelectric transducer for transforming a voice sung by a singer to an electric signal to output it as voice information;

a mixing unit for mixing the musical accompaniment information and the voice information to output it as mixed musical information; and a sound output unit for transforming the mixed musical information to sound to output it.

By employing such a configuration, it is possible to protect a music from being copied without permission from the recording medium.

BRIEF DESCRIPTION OF THE DRAWINGS

FIG. 3A, 3B, 3C is a view showing a further detailed configuration of the lyrics file in FIG. 1.

FIG. 6 is a view showing an example where an image of the Table is displayed.

FIG. 7 is a view showing an example where an image of the reservation state is displayed.

DETAILED DESCRIPTION OF THE PREFERRED EMBODIMENTS

Prior to the description of preferred embodiments of the present invention, the problems with conventional apparatuses for reproducing musical accompaniment information will be first described with reference to the attached drawings.

Figure 14:
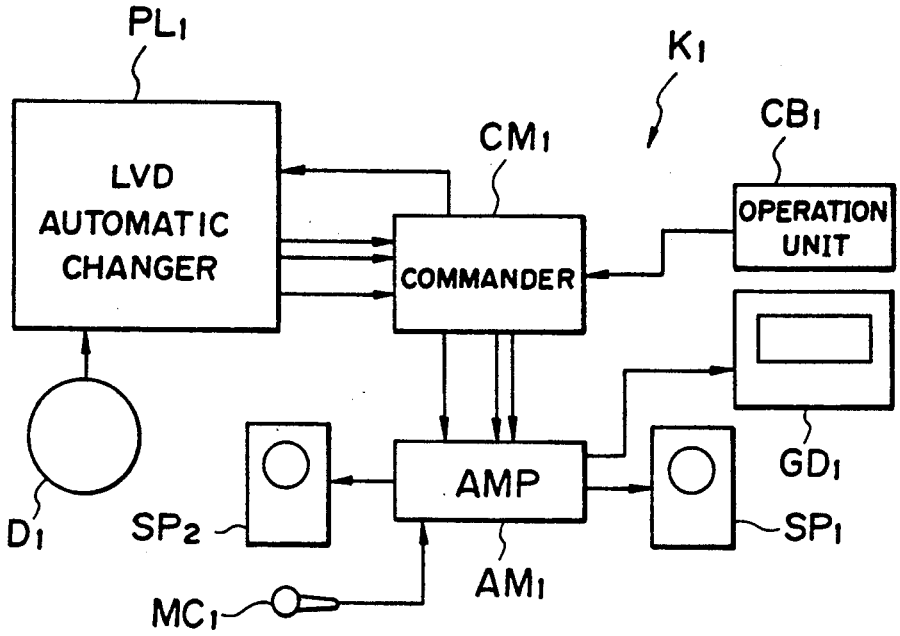
FIG. 14 is a block diagram showing the configuration of a conventional apparatus for reproducing musical accompaniment information in the form Of LVD.

FIG. 14 is a block diagram showing the configuration of an apparatus called an apparatus for reproducing musical accompaniment information in the form of LVD. This musical accompaniment information reproducing apparatus in the form of LVD designated by reference symbol K1 comprises a LVD automatic changer PL1 for accommodating therein a plurality of laser video disks D1 serving as a musical accompaniment information recording medium and reproducing them, a commander CM1 for controlling the LVD automatic changer PL1 to allow it to select a desired laser video disk D1 in the LVD automatic changer PL1 by a request inputted from operation unit CB1, an amplifier and speakers SP1 and SP2 for outputting as sound a reproduced audio signal, an image display unit GD1 for displaying a reproduced image signal as an image, and a microphone for changing a voice sung to an audio signal to output it to the amplifier AM1. The amplifier AM1 mixes an audio signal from the LVD automatic changer PL1 which is a musical signal from the so called musical accompaniment player and an audio signal of a voice sung from the microphone MC1 to output it to the speakers SP1 and SP2. It is to be noted that the commander may CM ordinarily include the operation unit CB1.

Figure 15:
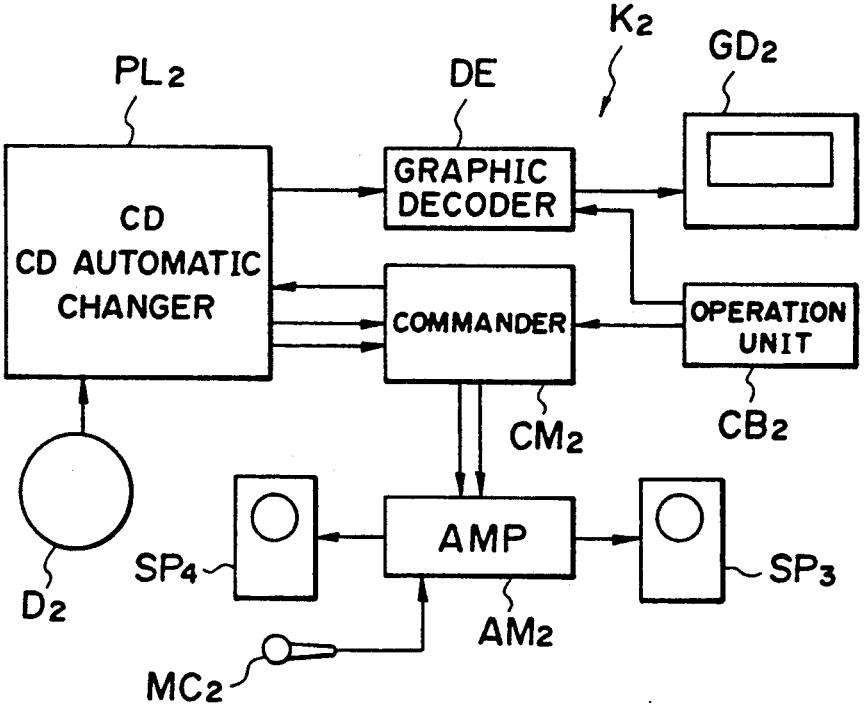
FIG. 15 is a block diagram showing the configuration of a conventional apparatus for reproducing musical accompaniment information in the form of CD.

Further, FIG. 15 is a block diagram showing the configuration of an apparatus called an apparatus for reproducing musical accompaniment information in the form of CD designated by K2. This musical accompaniment information reproducing apparatus in the form of CD designated by K2 comprises a CD automatic changer PL2 for accommodating therein a plurality of compact disks D2 serving as a musical accompaniment information recording medium and reproducing them, a commander CM2 for controlling the CD automatic changer PL2 to allow it to select a desired compact disk D2 in the CD automatic changer PL2 by a request inputted from the Operation unit CB2. An amplifier AM2 and speakers SP3 and SP4 for outputting a reproduced audio signal as sound, a graphic decoder DE for converting graphic data reproduced from the subcode data in the compact disk D2 to an image signal, an image display unit GD2 for displaying this image signal as an image, and a microphone MC2 for changing a voice sung to an audio signal to output it to the amplifier AM2. The amplifier AM2 mixes an audio signal from the CD automatic changer PL2 which is a musical signal from the so called musical accompaniment music player and an audio signal of a voice sung from the microphone MC2 to output it to the speakers SP3 and SP4. It is to be noted that the commander CM2 may ordinarily include the operation unit CB2 and the graphic decoder DE.

By constituting the apparatus for reproducing musical accompaniment information in this way, a singer can sing a song with a music from a musical accompaniment player as a musical accompaniment, and can enjoy, at the same time, a corresponding image.

However, in the musical accompaniment information recording media and the musical accompaniment information reproducing apparatuses in the conventional forms, in the case of delivering a song of a new music to the apparatus, it is required to deliver laser video disks or compact disks by human labor. Accordingly, there was the problem that it takes much time in delivery of a new music at a remote place, etc.

Further, since a large number of disks are accommodated in the automatic changer, a large space was required as the stock area.

In addition, in the case of singing a song, when an attempt is made to allow the key of the accompaniment music to be in correspondence with a singing ability of a singer, a key controller had to be separately installed.

Figure 16A:
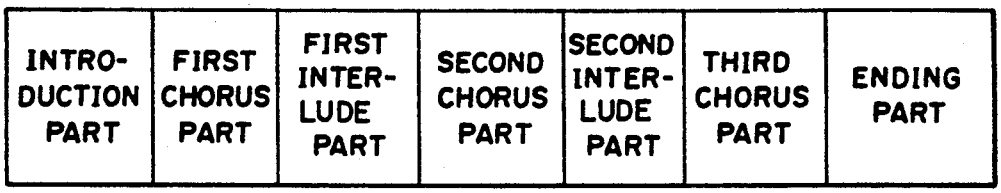
FIG. 16A, 16B, 16C is a view for explaining the problem in carrying out abbreviated reproduction by using a conventional apparatus for reproducing musical accompaniment information.
Figure 16B:
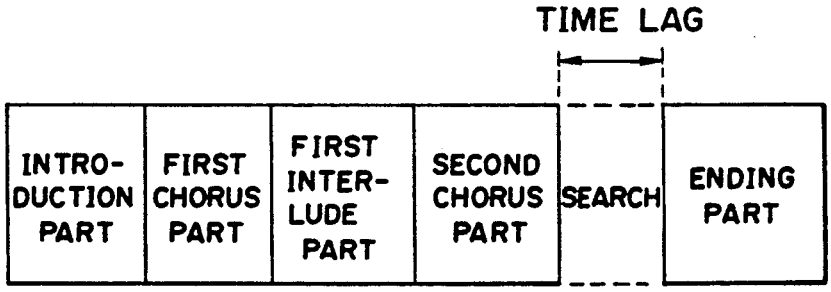
Figure 16C:
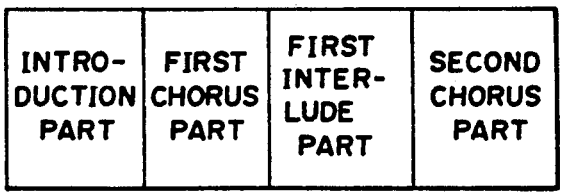

Further, in the conventional recording media and apparatuses, once a musical performance begins, it was impossible to play a music with an intermediate portion of a music being skipped. For example, let consider the case where the composition of a music is as shown in FIG. 16(A). At this time, in the case of attempting to jump from the second chorus part to the ending part with the second interlude part and the third chorus part being skipped, even if the function for performing the search operation is given, time lag is produced by a time required for the search operation as shown in FIG. 16(B), there results disagreement with the stream of music. Furthermore, if the search Operation is caused to be stopped on the way, the ending part would not be played as shown in FIG. 16(C), resulting in dull musical accompaniment performance. Thus, development of a music as expected cannot be provided.

On the other hand, recording media such as disks or tapes, etc. on which a music for accompaniment is recorded are apt to be copied. As a result, there were instances where a trouble at the time of the collection of the charge by the deliverer of software and/or that in relation to the copyright thereof occur.

First Embodiment

Prior to the description of a first embodiment of the present invention, the MIDI standard and the MIDI sound source used in this embodiment will be first described with reference to FIGS. 17, 18 and 19.

The MIDI (Musical Instrument Digital Interface) is the standard determined for permitting musical instruments such as synthesizer or electronic piano, etc. connected to each other to effect exchange of information therebetween.

Electronic instruments provided with a hardware based on the MIDI standard and having a function to carry out transmission and reception of a MIDI control signal serving as a musical instrument playing control signal in the form defined to support musical information are called MIDI equipments.

On disks such as CDs (Compact Disk), CD V (Video) or LVD (Laser Video Disk) including CD format digital sound, etc., Or tapes such as DAT, etc., subcodes are recorded. There are subcode of P, Q, R, S, T, U, V and W Channels. The P and Q channels thereof are used for the purpose of effecting control of a disk player and display.

On the other hand, R to W channels are empty channels called user's bit. Various studies of application to graphic, sound or image, etc. are being conducted. The standard with respect to the graphic format has been already proposed.

Further, MIDI format signals may be recorded in the user's bit area. The standard therefor has been already proposed.

In this case, an approach may be employed to deliver an audio video signal reproduced by the disk player to the AV system to carry out audio visual operation of a program recorded on the disk, and an approach may be also employed to allow the AV system itself to have such a function, or to deliver playing program information to other MIDI equipments. Accordingly, various studies of application to construction of the AV system with realism or presence including electronic musical instruments, or preparation of educational software, etc. are being conducted.

The MIDI equipments play music in accordance with the musical instrument performance program formed by a MIDI signal obtained by converting MIDI format signals sequentially delivered from the disk player to serial signals.

The MIDI control signal delivered to the MIDI equipment is serial data of a transfer rate 31.25 [Kbaud], and 10 bits in total of 8 data bits, one start bit and one stop bit of constitute one unit.

Further, at least one status byte for designating the kind of data sent and the MIDI channel and one or two data bytes introduced by that status byte are combined to form a message serving as musical information. Accordingly, one message is comprised of 1 to 3 bytes, and a transfer time of 320 to 960 [μsec] is required for the transfer. A musical instrument playing program is formed by a series of messages.

Figure 17:
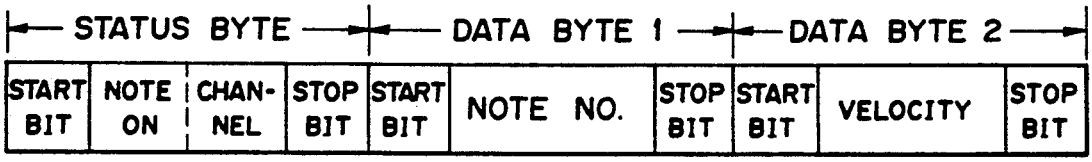
FIG. 17 is a view showing the configuration of a "note on message" in MIDI.
Figure 18:
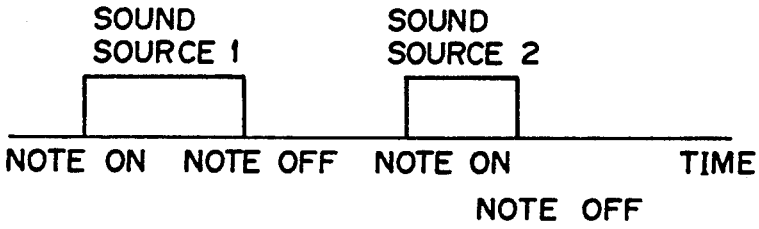
FIG. 18 is a view showing a "note on message" and a "note off message" in MIDI.

The configuration of a "note on message" which is one of channel voice messages is shown in FIG. 17 as an example of such a message.

The note on message of the status byte is a command corresponding to the operation that the key of the keyboard is depressed, and is used as a pair with a "note off message" corresponding to the operation that the key of the keyboard is released. Such a relationship is shown in FIG. 18. The note number of the data byte 1 designates any one of 128 stages assigned to the key with C of the center being as a center. The velocity of the data byte 2 is generally utilized for providing a difference of sound intensity. Responding to the note on message, the MIDI equipment generates a sound of a designated musical scale at a designated intensity. Further, responding to the note off message, the MIDI equipment carries out, e.g., the operation for allowing the key of the keyboard to be released.

Figure 19:
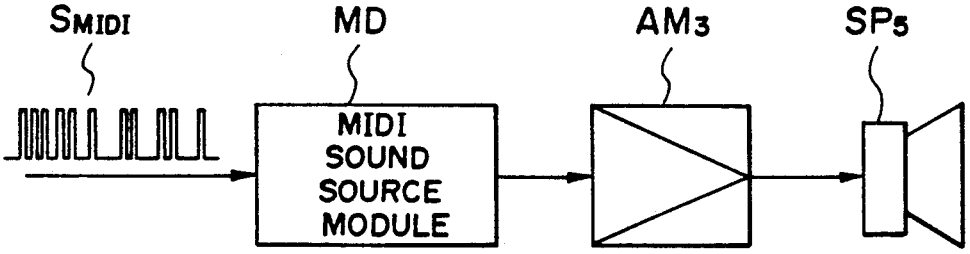
FIG. 19 is a view showing the principle of generation o musical sound in MIDI.

Accordingly, in place of the electronic musical instrument, as shown in FIG. 19, the MIDI sound source module MD, the amplifier AM3 and the speaker SP5 are used, thereby making it possible to generate an arbitrary musical sound by the MIDI control signal S MIDI.

A musical accompaniment information recording medium which is a first embodiment of the present invention will now be described with reference to FIG. 1.

Figure 1:
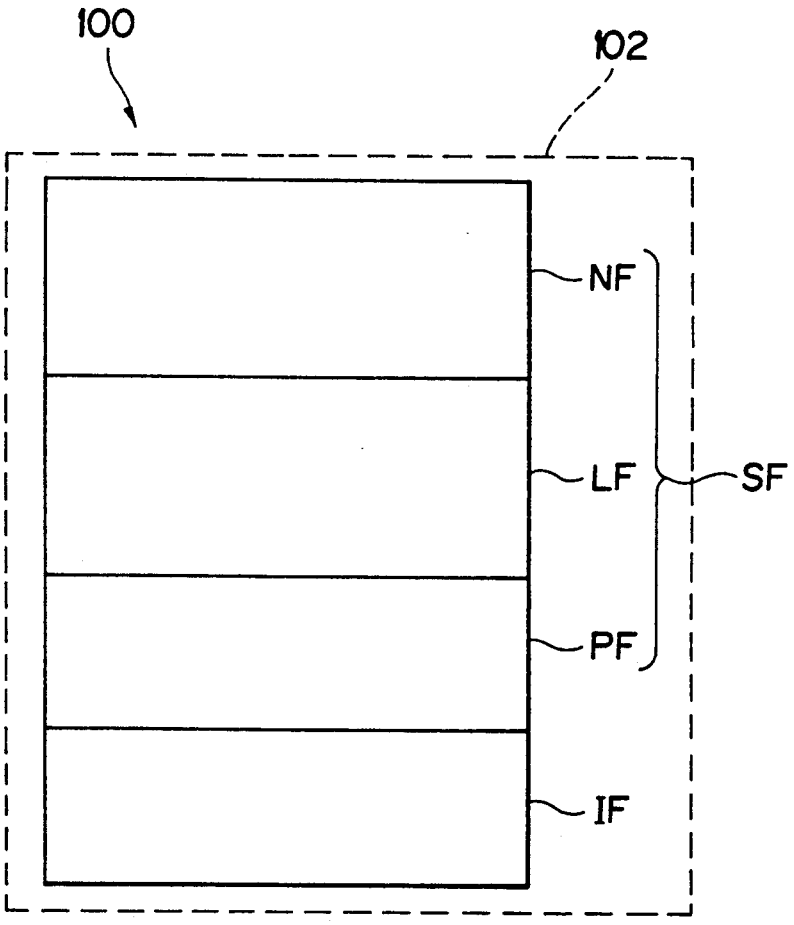
FIG. 1 is a view showing the configuration of a musical accompaniment information recording medium which is a first embodiment Of the present invention.

FIG. 1 shows the data structure of the MIDI accompaniment music playing file stored in an OMD (Optical Memory Disk) 100. The OMD is a writable optical disk used as a memory.

Figure 2:
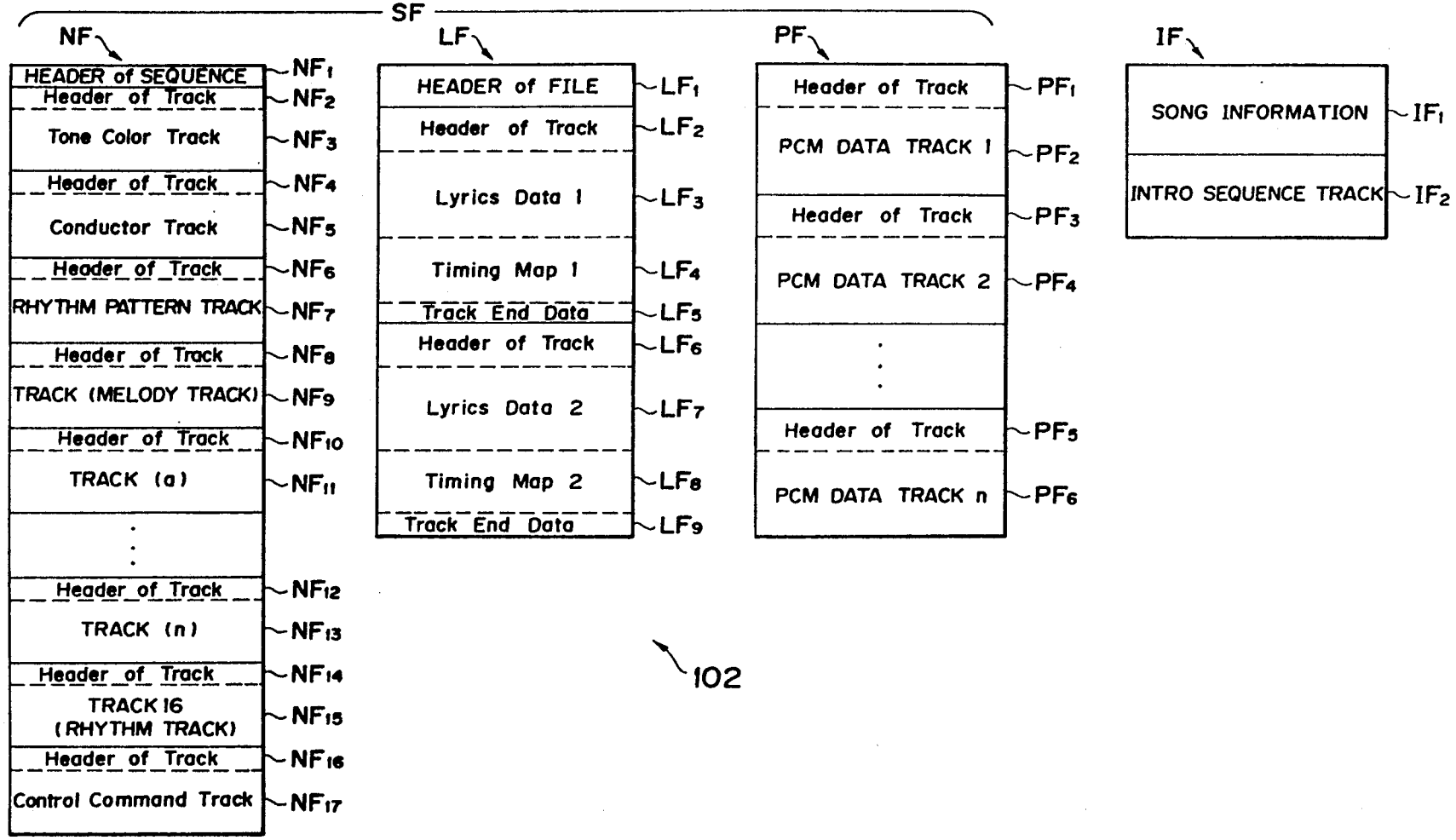
FIG. 2 is a view showing a detailed configuration of the first embodiment of the present invention.

This MIDI accompaniment music playing file format 102 is roughly classified into a sequence file SF and a Table file IF. The sequence file SF is a file required at the time of playing a musical accompaniment, and includes a note file NF serving as a first information recording area, a lyrics file LF serving as a fourth information recording area, and a PCM file PF serving as a second information recording area. The Table file IF corresponds to a fifth information recording area. Further, the lyrics file LF and the Table file IF constitutes a third information recording area. The detailed configuration of the respective files is shown in FIG. 2.

The note file NF is a file in which actual playing data is stored, and includes data areas of NF1 to NF17. Among them, the tone color track NF3 stores data for setting a plurality of tone colors of the MIDI sound source. The conductor track NF5 stores data for setting the rhythm and the tempo. The tempo change, etc. is stored into this data area. The rhythm pattern track NF7 stores pattern data corresponding to one measure of the rhythm in relation to rhythm. NF8 to NF 15 are called a note track. For this purpose, 16 tracks can be used at the maximum. Data for the MIDI sound source playing are stored therein. The track NF9 is a track exclusive for melody. The track 16 NF 15 is a track exclusive for rhythm. The track numbers a to n are 2 to 15. In addition, the control track NF17 stores various control commands such as illumination control or LD player control, etc.

The lyrics file LF is a file for storing data lyrics Telop displayed on a monitor television, and includes data area of LF1 to LF9. Among them, data of the lyrics themselves are stored into the LF3 and LF7. Further, data relating to the display timing of the lyrics and the color change speed (scroll) are stored into LF4 and LF8.

The further derailed structure of the lyrics file is shown in FIG. 3(A). FIG. 3 shows the example of LF2 to LF 5.

The track header section LF2 is a data area for storing data for designating a track length, an initial value of the lyrics Telop display color, and an initial value of the lyrics Telop scroll color, and includes data LF21 to LF26 as shown in FIG. 3. It is to be noted that data of the lyrics Telop display color and the lyrics Telop scroll color may be omitted. In this case, data are set to a predetermined initial value (default value) by the control unit.

The status LF21 Of the track length is one byte (FFh, h:hexadecimal digit) as shown in FIG. 3(A). and the track length data LF22 is four bytes. The data of LF22 is stored from the high order byte (MSB) of the track length from the first byte as shown in FIG. 3(B).

The status LF23 of the lyrics display color is one byte (AOh) as shown in FIG. 3, and the lyrics display color data LF24 is three bytes. The display color of the lyrics Telop is designated by B(blue), R(red) and G(green). The first, second and third byte of the data bytes correspond to B(blue), R(red) and G(green), and are designated in the range of OOh to OFh.

The status LF25 of the scroll color is one byte (BOh). and the scroll color data LF26 is three bytes. The specification of the data byte is the same as in the case of the lyrics display.

Figures 4, 5:
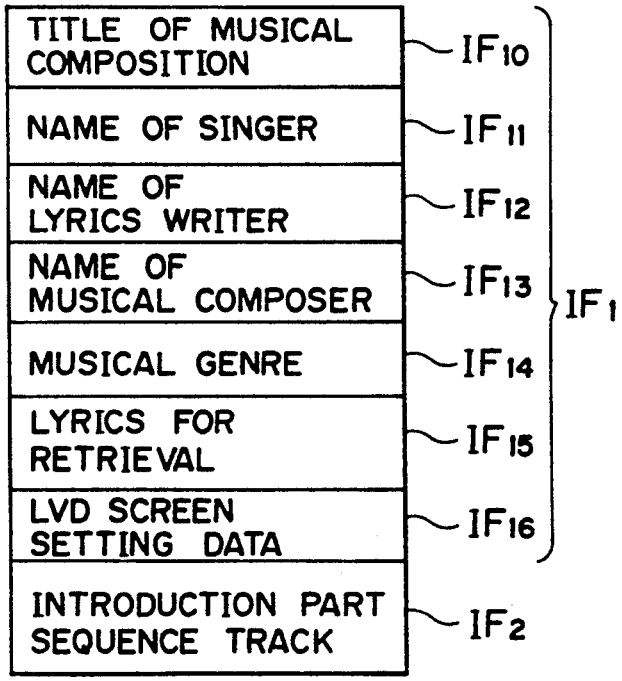
FIG. 4 is a view showing an example of a lyrics indication color code in FIG. 3.
FIG. 5 is a view showing an example of the detailed configuration of a Table file in FIG. 1.

An example of the color code by B, R and G is shown in FIG. 4. The lyrics data is stored in the form of the JIS (Japan Industrial Standard) code.

The status of the lyrics data LF3 is COh and the lyrics data succeeding to the status COh is displayed as the lyrics data by one frame. Further, lyrics train numbers are assigned to the lyrics data train succeeding to the status COh in order from 1. In addition, the status and the data of the data end is EOh.

In the data of the timing map LF4, there are included the lyrics Telop display timing, the lyrics Telop erase timing, the lyrics display color, the scroll map data, and the map end.

The status of the lyrics Telop display timing is DFh, and the data is three bytes of [Display Timing] and [lyrics Number].

At the timing of [Display Timing], the lyrics of the [Lyrics Number] are displayed. With respect to the display timing, the first byte and the second byte of data are stored into the area of the high order byte of timing and the area of the low order byte of timing in order recited.

The status 2 of the lyrics erase timing is DOh, and the data is two bytes of [Off Timing]. The first and second bytes of data correspond to the high order byte of timing and the low order byte of timing, respectively.

The status of the lyrics display color is AOh, and data is three bytes of [Display Color]. The data format is the same as the format of the lyrics display color in the track header. It is to be noted that the lyrics display color timing must be subsequent to the display timing of the lyrics Telop display timing.

The status of the scroll color is BOh, and data is three bytes of [Scroll Color]. The data format is the same as the format of the scroll color in the track header. In the timing map, the scroll color timing must be preceding to the scroll map data.

The status of the scroll map data is COh, and data is two bytes of [Scroll Speed]and [Lyrics Count]. The number of characters of [Lyrics Speed]is scrolled at a speed of the musical note of [Scroll Speed]per each character.

The status of the map end is EOh, and the data is EOh.

Further, the status of the track end is FEh, and the data is FEh.

Further, data of two languages or a parody of a song, etc. can be stored into the areas of LF6 to LF9. It is to be noted that such data are not stored when they are not used.

The PCM file is a file in which data of sound effect or background chorus, etc. that cannot be generated by the MIDI sound source, and includes data areas of PF1 to PF6. As the method of storing data, various methods such as the PCM (Pulse Code Modulation) method or the ADPCM (Adaptive Differential Pulse Code Modulation), etc. can be adopted.

The Table file IF is a file for retrieval, and includes IF1 and IF2. In the information file IF1, there are included the title of a musical composition, the name of a singer, the name of a lyrics writer, the name of a musical composer, genre of a music, lyrics inserted, LVD screen setting data and phrase data of the beginning portion of song, etc. On the introduction sequence track IF2, sequence data for allowing the MIDI sound source to play one phrase of a music is stored. An example of the detailed configuration of the Table file IF is shown in FIG. 5.

Further, the example where an image of these retrieval data is displayed as Table is shown in FIG. 6.

FIG. 7 shows an example of an image displayed in the case of the displaying the reservation state by making use of this Table data.

Second Embodiment

An apparatus for reproducing musical accompaniment information which is a second embodiment of the present invention will now be described with reference to FIG. 8.

Figure 8:
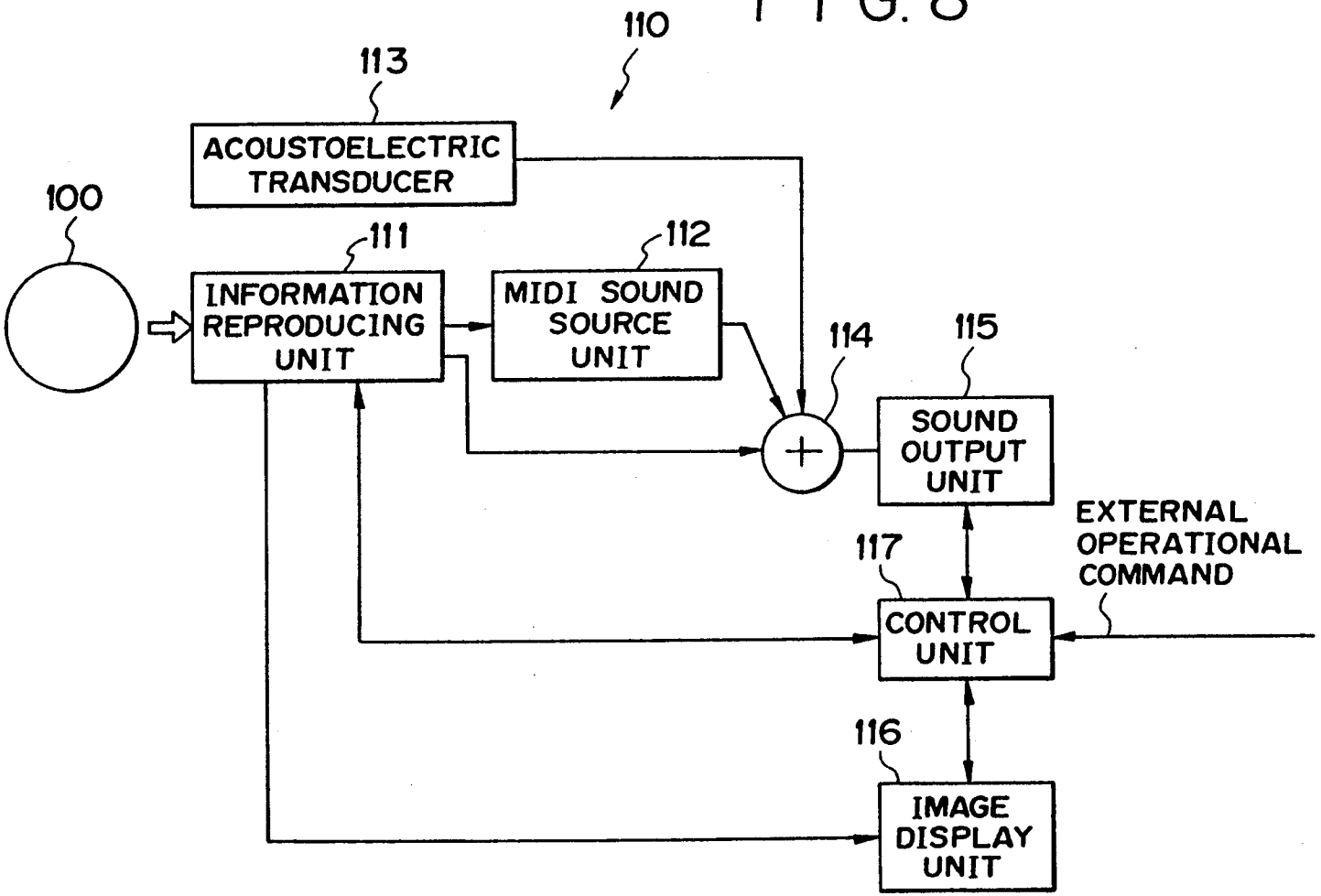
FIG. 8 is a block diagram showing the configuration of an apparatus for reproducing musical accompaniment information which is a second embodiment of the present invention.

As shown in FIG. 8, this musical accompaniment information reproducing apparatus 110 comprises an information reproducing unit 111 for reproducing information from a musical accompaniment information recording medium 100, a MIDI sound source unit 112 for generating first musical information by the MIDI sound souce control information reproduced by the information reproducing unit 111, an acoustoelectric transducer 113 for transforming a voice sung by a singer to an electric signal to output it as musical information, a mixing unit 114 for mixing the voice information, the first musical information and the second musical information reproduced by the information reproducing unit 111 to output it as mixed musical information, a sound output unit 115 for transforming the mixed musical information to sound to output it, an image display unit 116 for displaying an image of information reproduced by the information reproducing unit 111, and a control unit 117 responsive to an external operational command to control the information reproducing unit 111, the sound output unit 115 and the image display unit 116.

Figure 9:
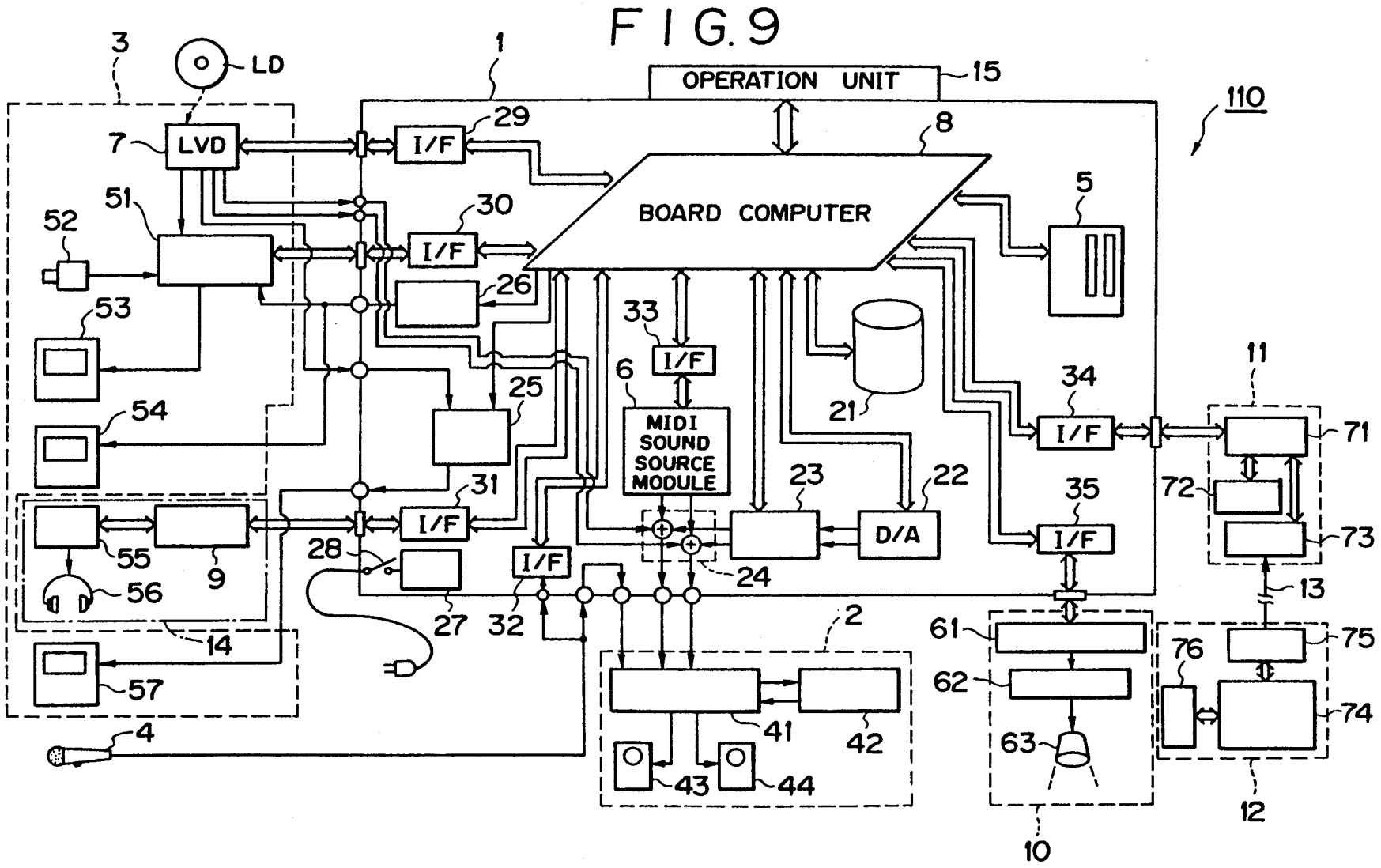
FIG. 9 is a block diagram showing the detailed configuration of the second embodiment of the present invention.

Further detailed configuration of the musical accompaniment information reproducing apparatus is shown in FIG. 9.

This musical accompaniment information reproducing apparatus 110 roughly comprises, as shown in FIG. 9, a MIDI control unit 1, a sound output system 2, an image display system 3, a microphone 4 serving as the acoustoelectric means, an illumination system 10, and a Table system 14. As the additional system, there are a data receiving system 11, and a data transmitting system 12 connected to the receiving system 11 through a telephone line 13.

More particulary, the MIDI contol unit comprises an OMDD (Optical Memory Disk Drive) 5 serving as the information reproducing unit for writing or reproducing information by using an OMD (not shown) serving as the musical accompaniment information recording medium, a MIDI sound source module 6 serving as the MIDI sound source unit, a board computer 8 serving as the control unit, an operation unit 15, a memory unit 21 such as a hard disk, etc. for accommodating the control program, etc. of the board computer 8, a D/A converter 22, a key controller 23, a mixer 24, a superimpose circuit 25, a video signal processing circuit 26, a power supply 27, a power switch 28, interfaces 29, 30, 31, 32, 33, 34 and 35.

Further, the sound output system 2 comprises an amplifier 41, a sound effector 42, and speakers 43 and 44. Here, the sound output system 2 the sound output unit. In addition, the mixer 24 constitutes the mixing unit.

The image display system 3 comprises a LVD player 7, an image effector 51, a video camera 52, a display 53 for a customer, and a display for a singer. Here, the image display system 3 constitutes an image display unit.

The Table system 14 includes a customer's seat terminal 9 for a singer, a display 54 for reservation, a MIDI sound source module 55, and a head phone 56.

The illumination sysytem 1O comprises an illumination controller 61, a driver 62 and an illumination unit 63.

The data receiving system 11 comprises a microcomputer 71, a memory unit 72 and a modem 73.

The data transmitting system 12 comprises a center computer 74, a modem 75 and a memory unit 76.

Figure 10:
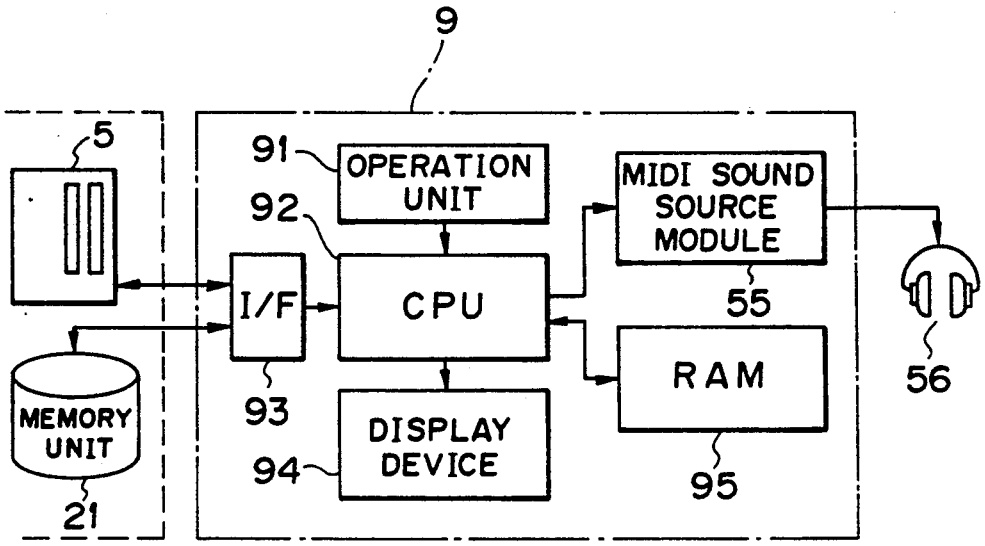
FIG. 10 is a block diagram showing the configuration of the seat terminal in FIG. 9.
Figure 11:
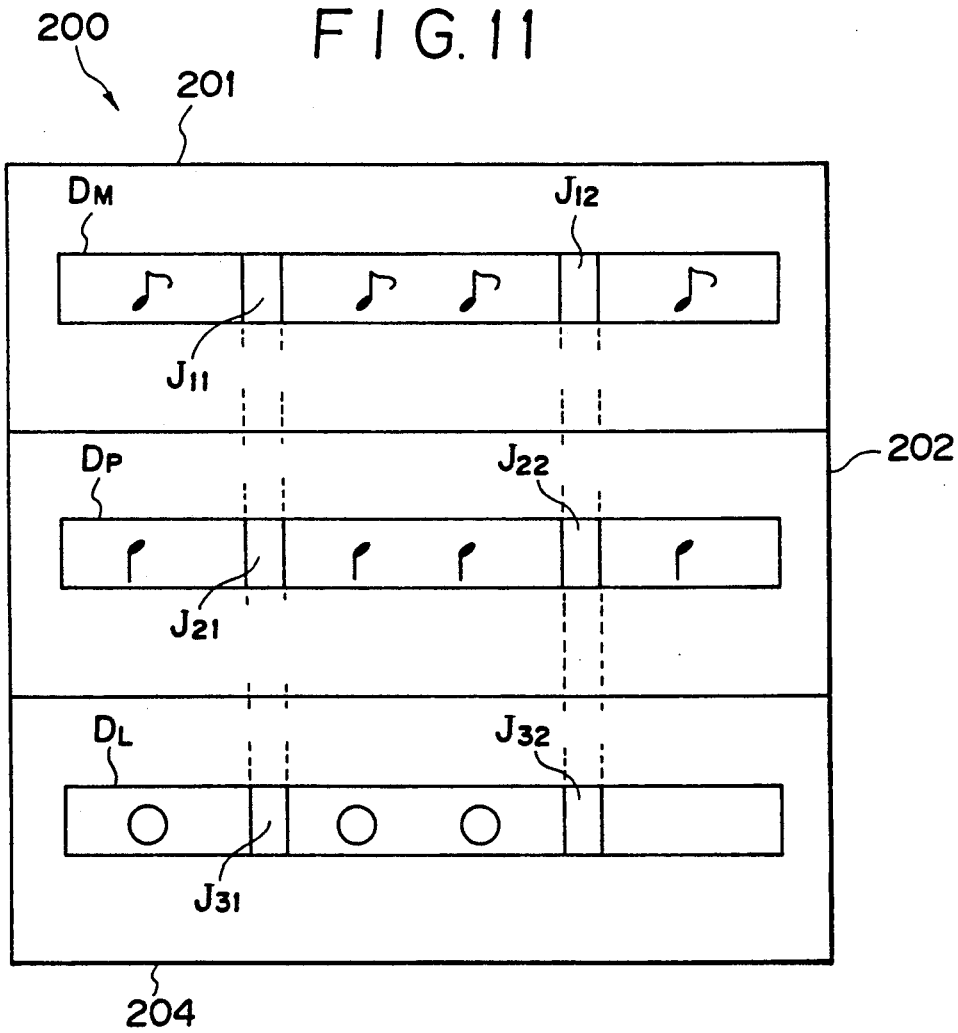
FIG. 11 is a view showing the configuration of a musical accompaniment information recording medium which is a third embodiment of the present invention.

Finally, the configuration of the customer terminal 9 will now be described with reference to FIG. 10. The customer terminal 9 comprises, as shown, an operation unit 91, a CPU 92, an interface 93, a display device 94, and a RAM 95.

The operation at the time of playing of the musical accompaniment information reproducing apparatus 11O will now be described.

The Table file IF of the MIDI musical accompaniment data is transmitted to a RAM (not shown) in the board computer 8 when the system is powered. The Table file IF is retrieved by operating the operation unit 15 to request a song that a singer desires to sing. The board computer 8 responds to the request to read, from the OMDD 5, data (note file NF, lyrics file LF, PCM file PF) of a corresponding music in the sequential file, thus to store it into the RAM in the board computer 8. As the music data, there are a note file NF (including image select data) transmitted to the MIDI sound source module 6, a lyrics file LF transmitted to the superimpose circuit 25, and a PCM file PF transmitted to the D/A converter 22.

Then, a command is transmitted to the LVD player 7 to allow it to search the background image designated as data in the Table file IF, thus causing the LVD player 7 to play music. At the same time when that image appears, musical performance begins. The board computer 8 reads out from the RAM, note file data NF to transform it to a MIDI signal to transmit that signal to the MIDI sound source module 6. Then, a audio signal from the MIDI sound source module 6 is transmitted to the mixer 24. In synchronism with this, PCM file data PF is read out. The data thus read out is transmitted to the D/A converter 22. The D/A converter 22 converts that data to an analog audio signal to transmit it to the mixer 24, at which two signals are mixed. The mixed signal thus obtained is delivered to the amplifier 41. Thus, sound is produced from the speakers 43 and 44. At the amplifier 41, a voice signal from the microphone is mixed with the above mentioned signal to produce sound from speakers 43 and 44. The board computer 8 reads out lyrics file data LF in synchronism with output of the MIDI signal and the PCM signal relating to voice to convert it to a character signal to deliver that character signal to the superimpose circuit 25. The superimpose circuit 25 superimposes the character signal and a video signal sent from the LVD player 7 to send it to the display 57 for a singer. A singer sings a song with a microphone 4 in his or her hand while looking at the display 57 and the lyrics thereon. Further, an approach may be employed to generate a key control signal from a signal generator (not shown) provided in the microphone 4 so as to become in correspondence with the pitch of a singer to send the MIDI signal and the PCM signal of which keys are changed in correspondence with change of the key at the control unit board computer 8, thereby making it possible to change the key of sound.

The operation relating to the data communication Of the musicsl accompaniment information reproducing apparatus will now be described.

In the existing apparatuses in the form of LVD and CD, delivery of new music is carried out by delivering disks to shops or homes where those apparatuses are installed. However, in the MIDI system, since the music is not in the form of disk, but in the form of data, it is possible to deliver it by making use of the data communication. The configuration therefor is roughly classified into data receiving system 11 and data transmitting system 12 on the delivery side, which are added to the musical accompaniment information reproducing apparatus 110.

The communication is carried out in accordance with a predetermined protocol. In the data communication system 12, the center computer 74 carries out supervisory control of the entirety thereof. This center computer 74 reads thereinto MIDI data stored in the memory unit 76 to send it to the data receiving system 11 in accordance with the above mentioned communication protocol through the modem 75. On the other hand, on the data receiving system 11 side, the microcomputer 71 carries out supervisory control of the entirety thereof to receive data through the modem 73 in accordance with the above mentioned communication protocol to temporarily store it into the memory unit 72. When all data have been transferred, communication is completed in accordance with the protocol. When the board computer 8 is not busy, data temporarily stored into the memory unit 72 is transferred to the OMDD 5 through the microcomputer 71 and the board computer 8, and is stored thereat. In this way, delivery of new music is carried out.

The board computer 8 controls the illumination system 10 on the basis of illumination control data in the note file NF, thus making it possible to provide atmosphere in harmony with the feeling of the music during playing of the music.

Further, in the case where a plurality of lyrics data are included in the lyrics file LF (for example, in the case of lyrics of three languages or more), lyrics (for example, lyrics of the Japanese) are ordinarily displayed. If a singer selects other lyrics by making use of the operation unit 15 depending upon his or her preference, alteration of music is ready to be changed at any time from that time point. For example, an alteration from the Japanese to the English, and to the Japanese for a second time may be carried out, or lyrics of the Japanese and the English may be displayed at the same time. In the lyrics data, display color and/or display timing, etc. are included.

Namely, in the case of a song where a plurality of lyrics are present with respect to one music, a singer can freely select desired lyrics. Further, musical accompaniment data for the foreign language and that for the Japanese may be commonly used. In addition, performance corresponding to the preference of a singer such as a duet together with a foreigner or singing a part to be sung in a chastened or practiced voice in English may be conducted.

In addition, not only lyrics of two languages but also a parody of song may be similarly displayed.

The operation relating to the Table system 14 will now be described with reference to FIG. 10.

The Table file IF is stored into RAM 95 by the OMDD 5 of the MIDI control unit when the system is powered. Since the Table file IF exists per each music, Table files corresponding to the number of songs stored in the OMDD 5 within the MIDI control unit I are stored into the RAM 95.

Thus, retrieval of musics can be conducted in dependency upon the title of a musical composition, the name of a singer, the name of a lyrics writer, the name of a musical composer, and genre, etc. Further, by transmitting sequence data of a retrieved music to the MIDI sound source module 55, a user can hear the introduction part (or a portion in the middle of the music).

Further, in the case where reservation of music is given, reservation data is temporarily stored into the memory unit 21 in the MIDI control unit 1. Then, data of the name of a musical composition, the name of a singer and the order of reservation, or a person who makes reservation are read out in addition to data of the number of the music, and are changed to character data. Those character data are displayed on a display. Thus, a user can understand at a glance the order of playing of a song that the user has reserved, or whether or not a song that the user wants to sing is already reserved, etc., which could not be grasped by conventional musical accompaniment players.

While explanation has been given in the above described embodiment in connection with the example where writable OMD is used as the information recording medium, such a medium is not necessarily required to be writable. For example, ordinary CDs, CD ROMs, semiconductor memories, IC cards, magnetic memories, or photomagnetic disks, etc. may be used for this purpose.

As described above, in accordance with the first and second embodiments, not only the musical accompaniment information format is easily provided, but also delivery of new music is easy. Further, the space required for installation of the apparatus is small, and the key control function is also provided. In addition, lyrics Telop display, Table display of musics, and display of reservation circumstances of music and reservation can be easily carried out.

Third Embodiment

A musical accompaniment information recording medium 200 which is a third embodiment of the present invention is shown in FIG. This recording medium 200 includes a first information recording region 201 for recording MIDI sound source control information DM, a second information recording region 202 for recording second musical information Dp, and a fourth information recording region 204 for recording lyrics information DL. The musical accompaniment is composed of the first and second musical information that the MIDI sound source generates by the MIDI sound source control information DM.

In the MIDI sound source control information area DM of the first information recording region 201, first jump start address information J11 and first jump end address information J12 for jumping the information generation operating position from an arbitrary position in &he generated musical accompaniment information DM to an arbitrary position in the musical accompaniment information DM are recorded. Further, in the second musical information area DP of the second information recording region 202, second jump start address information J21 and second jump end address J22 for jumping the information generation operating position from an arbitrary position in the generated second musical information DP to an arbitrary position in the second musical information DP are recorded. In addition, in the lyrics information area DL of the fourth information recording region 204, third jump start address information J31 and third jump end address information J32 for jumping the information generation operating position from an arbitrary position of generated lyrics information DL to an arbitrary position in the lyrics information DL are recorded.

Figure 12A:
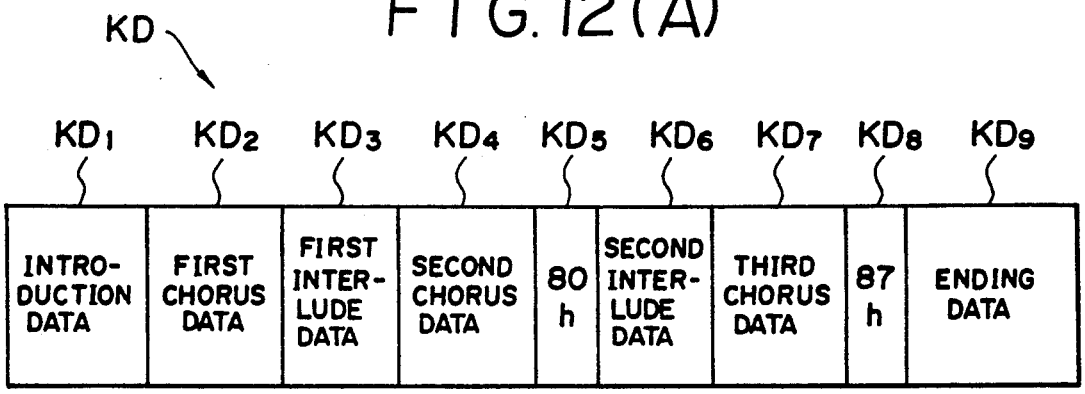
FIG. 12A, 12B, 12C is a view for explaining an example of the operation of the third embodiment of the present invention.

An actual example of the jump start address information and the jump end address information will now be described with reference to FIGS. 2 and 12.

Namely, the actual configuration of the first information recording region 201 of the third embodiment is the same as that of the note file in FIG. 2. Further, the actual configuration of the second information recording region 202 of the third embodiment is the same as that of the PCM file PF in FIG. 2. In addition, the actual configuration of the fourth information recording region 204 of the third embodiment is the same as that of the lyrics file LF in FIG. 2.

In the note file NF in FIG. 2, status byte and data byte are included in data of the melody track and the rhythm track. The status byte is 80h (h: hexadecimal digit) or more per each byte, and the data byte is 7Fh or less per each byte. By this status byte, the MIDI sound source discriminates data to play music. An example of how the status byte for shortened playing is set is shown in FIG. 12(A). FIG. 12(A) shows the configuration of musical accompaniment data KD in a melody track. Here, between the second chorus data KD4 and the second interlude data KD6, status byte 80h is provided. This corresponds to the first jump start address information. Further, between the third chorus data KD7 and the ending data KD9, status byte 87h is provided. This corresponds to the first jump end address information.

Figure 12B:
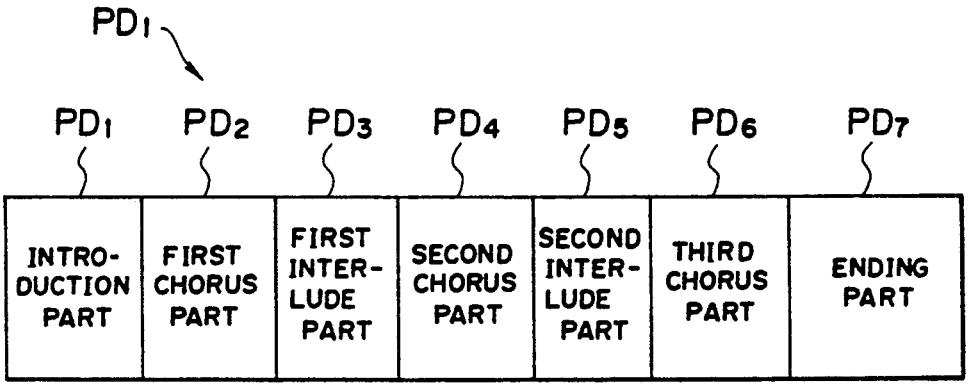
Figure 12C:
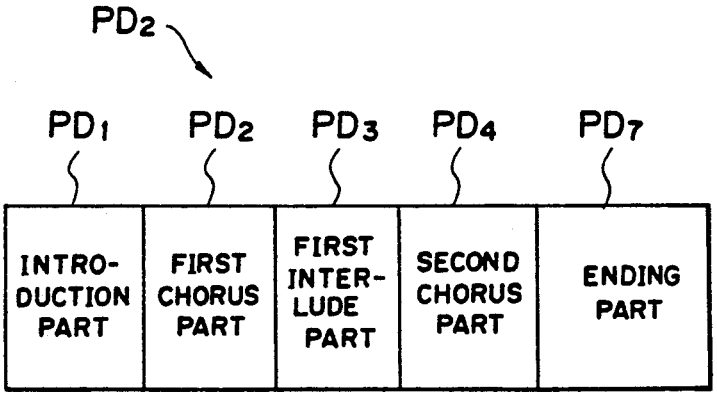

In this case, in the case where the musical accompaniment data of MIDI is constructed as shown in FIG. 12(A), if switching to shortened playing is not carried out at the operation unit 15 in the musical accompaniment information reproducing unit 110, the entirety of the music PD1 is played as shown in FIG. 12(B). In contrast, if the shortened playing switch of the operation unit 15 is turned ON, the board computer 8 read thereinto the status byte 80h (KD5) of the jump start address in the musical accompaniment data KD thereafter to carry out data search of the status byte 87h (KD8) of the jump destination address to restart data read in from that time, thus making it possible to carry out a shortened playing by the composition PD2 of music in which the second interlude part PD5 and the third chorus part PD6 are skipped.

While explanation has been given in the above described embodiment in connection with the example where writable OMD is used as the information recording medium, such information recording medium is not necessarily required to be writable. For example, ordinary CDs, CD ROMs, semiconductor memories, IC cards, magnetic memories, or photomagnetic disks etc. may be employed for this purpose.

While, in the above described embodiment, the jump start status byte is set at the position preceding in time to the jump destination status byte, a setting opposite to the above may be made such that the jump start status byte is set at the position succeeding in time to the jump destination status byte. By employing such a system configuration, repeat or refrain playing may be carried out. Further, there may be employed a system configuration such that a plurality of jump start/jump destination status bytes are set in the music to play the music with a portion thereof being arbitrarily skipped. These status bytes can be set from the external through the operation unit and the board computer.

Fourth Embodiment

An apparatus for reproducing musical accompaniment information which is a fourth embodiment of the present invention will now be described.

Figure 13:
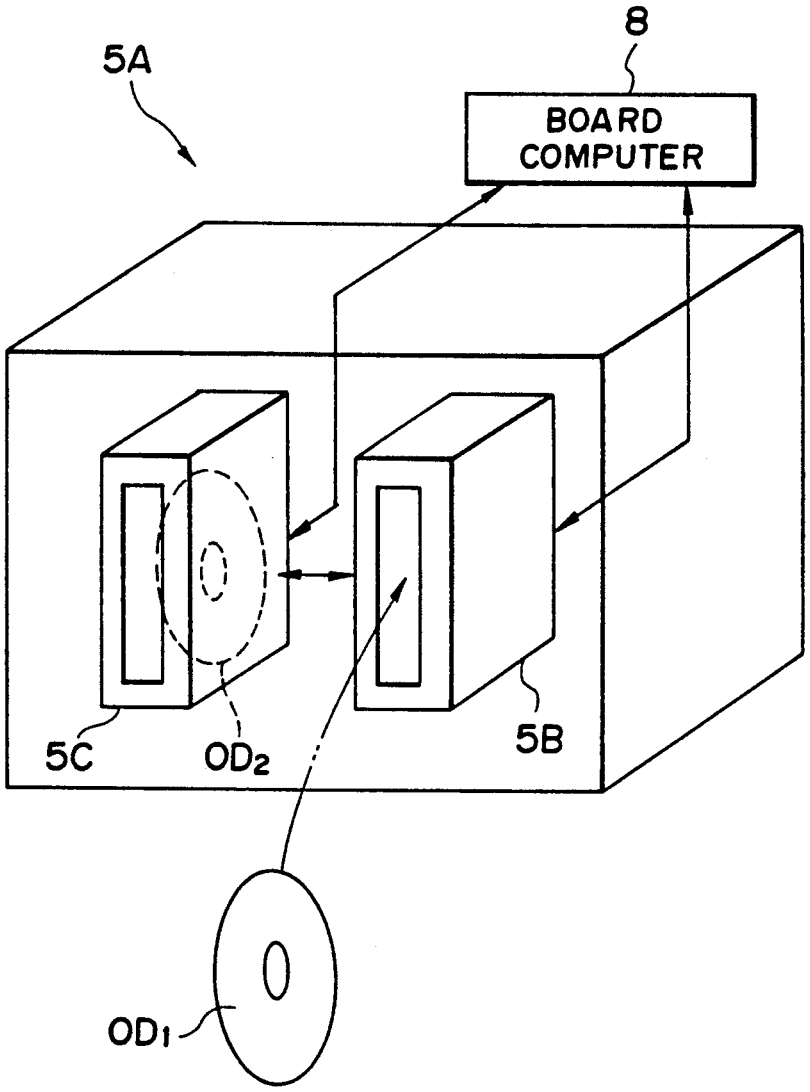
FIG. 13 is a view for explaining the configuration of an apparatus for reproducing musical accompaniment information which is a fourth embodiment of the present invention.

FIG. 13 shows a portion of the musical accompaniment information reproducing apparatus of the fourth embodiment. This portion shows the portion 5A corresponding to the OMDD 5 in FIG. 9.

This OMDD 5A includes, as shown in FIG. 13, an OMDD 5B for the delivery OMD and a recording OMDD 5C. The OMDD 5B for the delivery OMD and the OMDD 5C for the recording OMD are connected to each other, and they are both connected to the board computer 8 in FIG. 9 through a bus. A delivery OMD OD1 is load into the OMDD 5B for the delivery OMD, and a recording OMD OD2 can be loaded into the OMD 5C for the recording OMD. Here, the OMDD 5B for the delivery OMD corresponds to the first information recording/reproducing means, and the OMD 5C for the recording DMD corresponds to the second information recording/reproducing write means. Further, the delivery OMD OD1 corresponds to the first musical accompaniment recording medium, and the recording OMD OD2 corresponds to the second musical accompaniment information recording medium.

The operation at the time of playing of the fourth embodiment will now be described.

Initially, as shown in FIG. 13, prior to playing, a delivered OMD OD1 for delivery is loaded into the OMDD 5B for the delivery OMD. In this case, the same data corresponding to the number of copying times (n) is stored into the OMD OD1. By the control of the board computer 8, the record information contents corresponding to a single copying in the delivery OMD OD1 is sent to the OMDD 5C for the recording OMD, and is stored into the recording OMD OD2. At the same time, under the control of the board computer 8, the recording information contents corresponding to a single copying of the delivery OMD OD1 is erased by irradiating an intensive laser beam from the optical pick up of the OMDD 5B for the delivery OMD. Thus, each recording content is erased every copying (every delivery). Thus, when n number of copying times are carried out, the record information contents of the delivery OMD OD1 are all erased. At times subsequent thereto, copying will be impossible.

The operation at the time of playing of the fourth embodiment is not limited to the above mentioned operation, but may be carried out in the following manner. Namely, information (n) indicative of the number of copying times is stored in advance into the OMD OD1. Under control of the board computer 8, copied recording information contents in the delivery OMD OD1 are sent to the OMDD 50 for the recording OMD, and are stored into the recording OMD OD2. At the same time, by the control of the board computer 8, information (n−1) indicative of the number of copying times obtained by substracting 1 from the number of copying times (n) is stored into the delivery OMD OD1. In this way, copying number information is subtracted by one every copying (every delivery). When n number of copying times are carried out, the copying number information n of the delivery OMD OD1 becomes equal to zero. At times subsequent thereto, copying will be impossible.

Further, in the above described embodiment, there may be employed a system configuration such that the delivery OMD is independently provided separately from the musical accompaniment information reproducing apparatus body to deliver data through an interface. Furthermore, there may be employed a system configuration such that the musical accompaniment player has a function to identify ID data (Identification Data) in order to identify whether or not the recording OMD is the OMD for MIDI musical accompaniment player. When such a system configuration is employed, the reliability is improved.

As described above, in accordance with the third and fourth embodiments, music can be played without time lag in a manner that the middle portion of the music is skipped, and copy protecting function of the musical accompaniment is provided. Accordingly, expansion of the function, protection of an unfair copying, precise collection of charge, and solution of the copyright problem, etc. are usefully provided. In addition, sound expansion and control of the system are also advantageously provided.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An apparatus for reproducing musical accompaniment information comprising:

information reproducing means for reproducing information including MIDI sound source control information from musical accompaniment information recording for recording a plurality of music pieces, said information reproducing means comprising:

a first information recording region for recording MIDI sound source control information for controlling said MIDI sound source means to generate the musical accompaniment information in conformity with the MIDI standard, said first information recording region including first jump start address information and first jump end address information being larger than said first jump start address information, said first jump address information and said first jump end address information being fixed information predetermined for each of said music pieces;

said MIDI sound source means for generating the first musical information by the MIDI sound source control information reproduced by said information reproducing means, said MIDI sound source control information being suppressed in time-base compared with the musical accompaniment information;

an acoustoelectric transducer for transforming a voice sung by a singer to an electric signal to be output as voice information;

mixing means for mixing the first musical information generated by said MIDI sound source means and the voice information to output mixed musical information;

sound output means for transforming the mixed musical information to sound to be output; and control means for controlling said information reproducing means, when said first jump start address information is detected, to jump an information reproduction position from an information position of the first jump start address information to an information position of the first jump end address information so as to continue reproduction of the MIDI sound source control information from the information positon of the first jump end address information.

2. An apparatus as set forth in claim 1, wherein said first jump start address corresponds to an address between second and third part of a music piece and said first end address corresponds to an address between third part and ending part of the music piece.

3. An apparatus for reproducing musical accompaniment information according to claim 1, wherein said information recording medium further comprising:

a second information recording region on which second musical information to be mixed with the first musical information to form the musical accompaniment information is recorded, said MIDI sound source control information and said second musical information being recorded corresponding to each other in time for each of said music pieces so as to be synchronously reproduced, said second information recording region including second jump start address information and second jump end address information being larger than said second jump start address information, and said control means controls said information reproducing means, when the second jump start address information is detected, to jump an information reproduction position from an information position of the second jump start address information to an information position of the second jump end address information so as to continue reproduction of the second musical information from the information positon of the second jump end address information.

4. An apparatus for reproducing musical accompaniment information according to claim 3, wherein said information recording medium further comprising:

a lyrics information recording region on which lyrics information to be sung in harmony with the first musical information is recorded, said lyrics information recording region including third jump start address information and third jump end address information being larger than said third jump start address information, said third jump address information and said third jump end address information being fixed information predetermined for each of said music pieces, and said control means controls and information reproducing means, when the third jump start address information is detected, to jump an information reproduction position from an information position of the third jump start address information to an information position of the third jump end address information so as to continue reproduction of the lyrics information from the information position of the third jump end address information.

5. An apparatus for reproducing musical accompaniment information from an optical memory type disk medium comprising:

first information recording/reproducing means having a function to reproduce or erase MIDI sound source control information from a first optical memory disk type musical accompaniment information recording medium in which at least recording erasing or rewriting of the MIDI sound source control information for controlling MIDI sound source means to generate musical accompaniment information in conformity with a MIDI standard can be conducted;

second information recording/reproducing means having a function to record the MIDI sound source control information reproduced by said first information recording/reproducing means onto a second optical memory disk type musical accompaniment information recording medium in which at least recording, erasing or rewriting of the MIDI sound source control information can be conducted;

control means for controlling to record information contents recorded on said first musical accompaniment information recording medium onto said second musical accompaniment information recording medium, when said first musical accompaniment information recording medium loaded into said first information recording/reproducing means, and to erase the information contents recorded on said first musical accompaniment information recording medium immediately after the recording onto said second musical accompaniment information recording medium;

MIDI sound source means for generating the musical accompaniment information by the MIDI sound souce control information from said second musical accompaniment information recording medium reproduced by said second information recording-/reproducing means;

an acoustoelectric transducer for transforming a voice sung by a singer to an electric signal to be output as voice information;

mixing means for mixing the musical accompaniment information and the voice information to output mixed musical information, and sound output means for transforming the mixed musical information to sound to be output.

6. A musical accompaniment information recording medium, which is adapted to be reproduced by an apparatus for reproducing musical accompaniment information, said apparatus comprising:

information reproducing means for reproducing MIDI sound source control information from said musical accompaniment information recording medium on which the MIDI sound source information for controlling MIDI sound source means to generate musical information in conformity with a MIDI standard is recorded;

said MIDI sound source means for generating the musical information by the MIDI sound source control information reproduced by said information reproducing means;

an acoustoelectric transducer for transforming a voice sung by a singer to an electric signal to be output as voice information;

mixing means for mixing the musical information and the voice information to be output as mixed musical information; and sound output means for transforming the mixed musical information to sound to be outputted;

said musical accompaniment information recording medium for recording a plurality of music pieces comprising:

a first information recording region on which the MIDI sound control information for controlling said MIDI sound source means to generate first musical information in conformity with the MIDI standard is recorded; and a second information recording region on which second musical information mixed with the first musical information to form the musical accompaniment information is recorded, said MIDI sound source control information and said second musical information being in correspondence with each other in time for each of said musical pieces;

wherein said first information recording region includes first jump start address information and first jump end address information corresponding to said first jump start address information and larger than said first jump start information, said second information recording region includes second jump start address information and second jump end address information larger than said second jump start information, said first jump address information, said first jump end address information, said second jump start information and said second jump end information being fixed information predetermined for each of said music pieces, said MIDI sound source means generating the first musical information from a position corresponding to said first jump end address information after the generation of the first musical information corresponding to said first jump start address information, and said information reproducing means reproducing the second musical information from a position correspondingly to said second jump end address information after the reproduction of the second musical information corresponding to said second jump start address information.

7. A musical accompaniment information recording medium, which is adapted to be reproduced by an apparatus for reproducing musical accompaniment information, said apparatus comprising:

information reproducing means for reproducing MIDI sound source control information from said musical accompaniment information recording medium on which the MIDI sound source information for controlling MIDI sound source means to generate musical information in conformity with a MIDI standard is recorded;

said MIDI sound source means for generating the musical information by the MIDI sound source control information reproduced by said information reproducing means;

an acoustoelectric transducer for transforming a voice snug by a singer to an electric signal to be output as voice information;

mixing means for mixing the musical information and the voice information to be output as mixed musical information; and sound output means for transforming the mixed musical information to sound to be outputted;

said musical accompaniment information recording medium for recording a plurality of music pieces comprising:

a first information recording region on which the MIDI sound control information for controlling said MIDI sound source means to generate first musical information in conformity with the MIDI standard is recorded;

a second information recording region on which second musical information mixed with the first musical information to form the musical accompaniment information is recorded, said MIDI sound source control information and said second musical information being in correspondence with each other in time for each of said musical pieces;

a third information recording region where information related to the contents of the musical accompaniment information is recorded; and a fourth information recording region where lyrics information to be sung in harmony with the musical accompaniment information is recorded;

wherein said fourth information recording region includes third jump start address information and third jump end address information corresponding to said third jump start address information, said third jump address information and said third jump end address information being fixed information for each of said music pieces, and said information reproducing means reproducing the lyrics information from a position corresponding to said third jump end address information after the reproduction of the lyrics information corresponding to said third jump start address information.

* * * * *